US006666533B1

(12) United States Patent
Stavros

(10) Patent No.: US 6,666,533 B1
(45) Date of Patent: Dec. 23, 2003

(54) DRAWER ORGANIZER

(76) Inventor: Roseanne Stavros, 21 Old Barn Rd., Hawthorn Woods, IL (US) 60047

( * ) Notice: Subject to any disclaimer, the term of this patent is extended or adjusted under 35 U.S.C. 154(b) by 0 days.

(21) Appl. No.: 10/106,396

(22) Filed: Mar. 26, 2002

(51) Int. Cl.[7] ..... A47B 88/00
(52) U.S. Cl. ..... 312/348.3; 211/59.3
(58) Field of Search ..... 312/330.1, 348.3, 312/319.1, 61, 71; 211/59.3; 220/529, 534, 544, 552

(56) References Cited

U.S. PATENT DOCUMENTS

| | | | | | |
|---|---|---|---|---|---|
| 2,268,637 | A | * | 1/1942 | Bernstein | 312/348.3 X |
| 4,305,629 | A | * | 12/1981 | Friis | 312/204 |
| 4,436,355 | A | | 3/1984 | Fortune | |
| 4,595,246 | A | * | 6/1986 | Bross | 312/348.3 |
| 4,730,741 | A | * | 3/1988 | Jackle, III et al. | 211/59.3 |
| 4,762,236 | A | * | 8/1988 | Jacle, III | 211/59.3 |
| 5,011,241 | A | * | 4/1991 | Horton et al. | 312/330.1 |
| 5,240,125 | A | * | 8/1993 | Kunz | 211/59.3 |
| 5,242,223 | A | * | 9/1993 | Koves | 312/348.3 |
| 5,853,239 | A | | 12/1998 | Laib et al. | |
| 5,881,910 | A | * | 3/1999 | Rein | 221/59.3 X |

FOREIGN PATENT DOCUMENTS

| | | | | |
|---|---|---|---|---|
| DE | 3700435 | * | 7/1988 | 312/348.3 |
| FR | 2545340 | * | 11/1984 | 312/348.3 |

* cited by examiner

*Primary Examiner*—James O. Hansen
(74) *Attorney, Agent, or Firm*—Thomas R. Vigil; Welsh & Katz, Ltd.

(57) ABSTRACT

A drawer organizer assembly comprising two, first rectangular divider plates each having two long edges and two short edges and a plurality of spaced apart slots extending part way into the first divider plate from one long edge thereof; at least three, second rectangular divider plates each having two long edges and two short edges and at least two slots extending part way into each second divider plate from one long edge thereof; the divider plates being assembled with the first divider plates being arranged, respectively, in a front area of a drawer and a rear area of a drawer, the second divider plates being received in one of the slots in the first divider plate to form at least one elongate product receiving trough; and at least one elongate biasing assembly being received in the trough for urging boxes of a product in the trough toward the front area of the drawer.

2 Claims, 2 Drawing Sheets

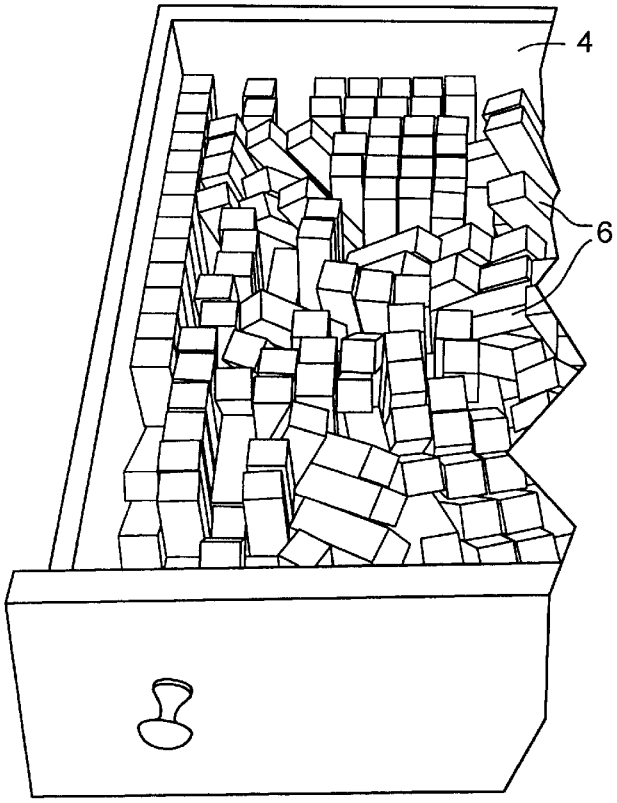
FIG. 1
PRIOR ART
FIG. 2
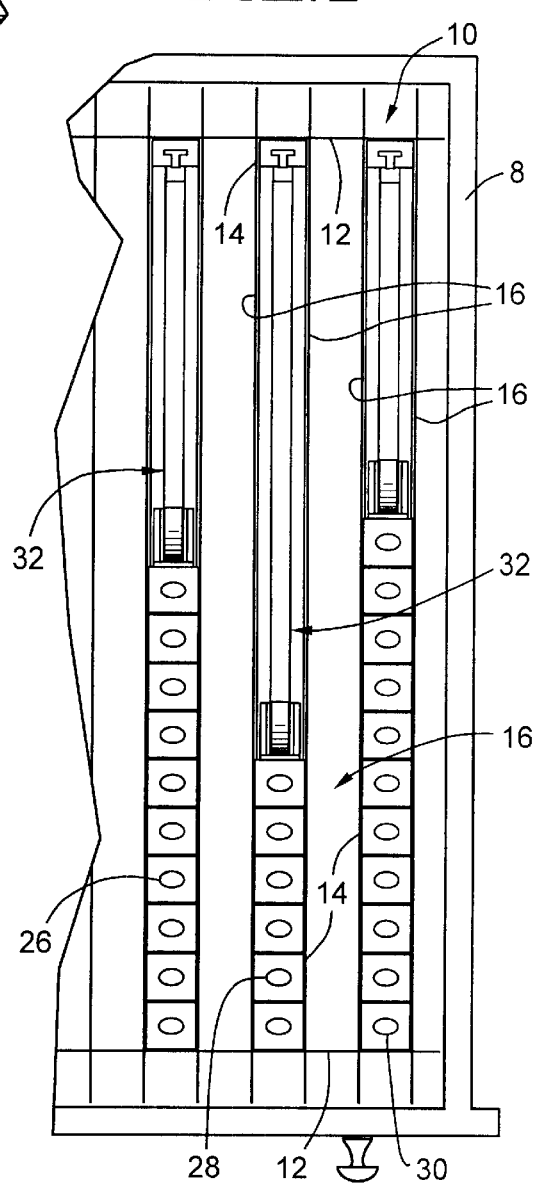

DRAWER ORGANIZER

BACKGROUND OF THE INVENTION

1. Field of the Invention

The present invention relates to a drawer organizer for organizing, in rows, boxes of different brands of a product. Each row has boxes of one brand of product. The boxes are thin elongate boxes, such as, for example, a box for a bottle of perfume, and the boxes all having generally the same shape.

2. Description of the Prior Art

Heretofore various draw organizers have been proposed. Examples of two such drawer organizers are disclosed in the following U.S. patents:

| U.S. Pat. No. | Patentee |
|---|---|
| 4,436,355 | Fortune |
| 5,853,239 | Laib et al. |

Over the years, many different types of drawer organizers have been proposed for organizing different items.

As described hereinafter in greater detail, the present invention is directed to a drawer organizer for storage of boxes of products of different sizes in rows, one row for each size or brand, so that one can pick out a box having a particular product therein without having to pick up several boxes to find a particular box for a particular product that one is looking for.

The drawer organizer can be used to organize boxes containing small products, such as perfume, cosmetics or hospital supplies wherein the boxes are substantially the same size but contain different products.

As will be described in greater detail hereinafter, the present invention includes an assembly of parts for organizing boxes in rows such that each row will contain a specific product and whereby the boxes will be maintained in the row in an upright position.

SUMMARY OF THE INVENTION

According to the present invention, there is provided a drawer organizer assembly comprising two, first rectangular divider plates each having two long edges and two short edges and a plurality of spaced apart slots extending part way into the first divider plate from one long edge thereof; at least three, second rectangular divider plates each having two long edges and two short edges and at least two slots extending part way into each second divider plate from one long edge thereof; the divider plates being assembled with the first divider plates being arranged, respectively, in a front area of a drawer and a rear area of a drawer, the second divider plates being received in one of the slots in the first divider plate to form at least one elongate product receiving trough; and at least one elongate biasing assembly being received in the trough for urging boxes of a product in the trough toward the front area of the drawer.

BRIEF DESCRIPTION OF THE DRAWINGS

FIG. 1 is a perspective view with portions broken away of a prior art drawer used to store boxes of product of different brands and shows a disarray or mixing of the boxes of different brands of product that can come about over a period of time.

FIG. 2 is a top plan view of the drawer organizer of the present invention where, three alternate rows of boxes are shown in spaced apart troughs and it is to be understood that all of the rows can have rows of boxes therein biased to an upright position biased toward the front of the drawer as shown.

BRIEF DESCRIPTION OF THE EMBODIMENT (S)

Figure 3:
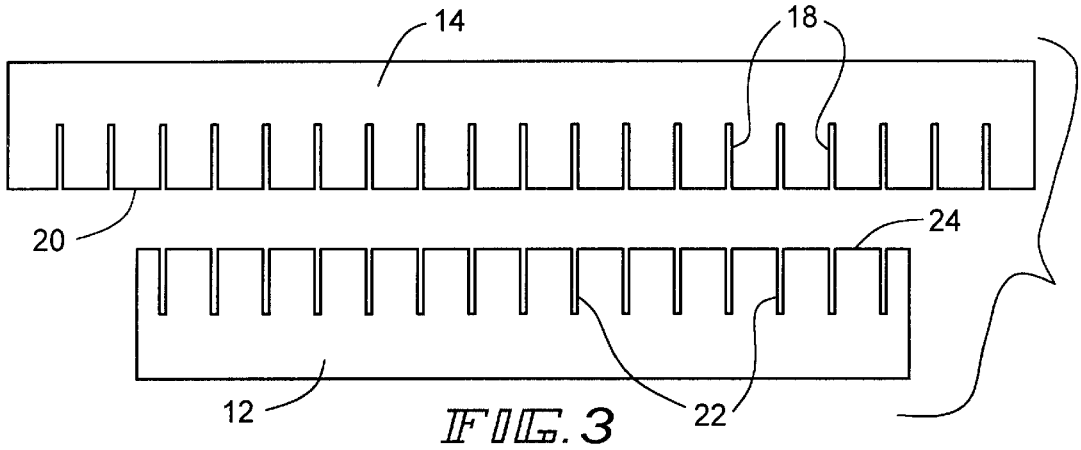
FIG. 3 is a plan view of divider plates which are used to form the troughs shown in FIG. 2.

Referring now to the drawings in greater detail, there is illustrated in FIG. 1 a conventional prior art drawer 4 having a plurality of boxes 6 of different brands of product loosely mixed in the drawer 4.

This loose mixing of the boxes 6 in the drawer requires a sales person to pick up several boxes 6 before he or she finds a desired box of a particular brand of product. This is time consuming and frustrating.

In FIG. 2, there is shown a top plan view of a drawer 8 having a drawer organizer 10 constructed according to the teachings of the present invention releasably mounted therein. The drawer organizer 10 includes at least two short plate shaped, slotted dividers 12 and a plurality of long plate shaped, slotted dividers 14. The shapes of the short dividers 12 and the long dividers 14 are shown in FIG. 3. These dividers 12 and 14 are positioned in the drawer 8 in the manner shown in FIG. 2 to create elongate troughs 16.

The divider 12 has a plurality of spaced apart slots 18 extending into the divider 12 from an elongate edge 20 thereof approximately halfway across the width W of the divider 12.

In like manner, the divider 14 has a plurality of spaced apart slots 22 which extend into the divider 14 from one elongate edge 24 approximately halfway across the width W' of the divider 14.

The dividers 12 and 14 have more slots than necessary so that the dividers 12 and 14 can be cut to any desired length for being received and assembled in different size drawers.

As shown in FIG. 2, the dividers 12 and 14 are assembled in a conventional manner by aligning certain slots 18 in dividers 12 with certain slots 22 in the dividers 14 and then pushing the dividers 12 and 14 toward each other to create the troughs 16.

Figure 4:
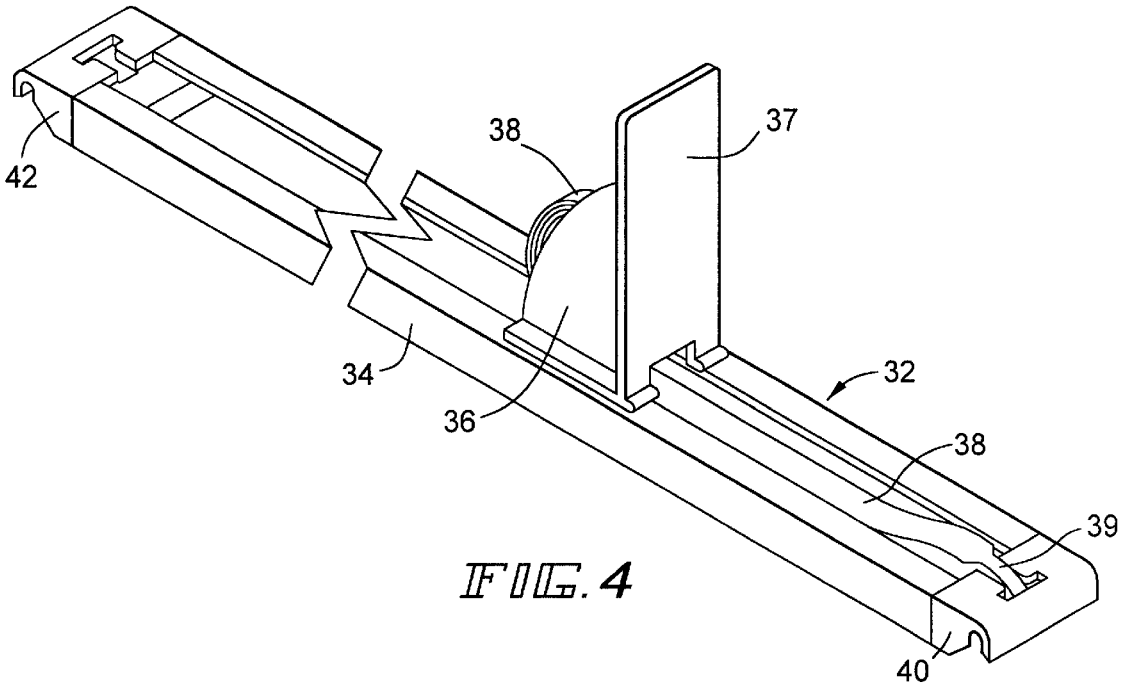
FIG. 4 is a perspective view of a pusher assembly which is positioned in each one of the troughs shown in FIG. 2 established by a plurality of the dividers shown in FIG. 3.

For the sake of clarity, only alternate troughs 16 are partially filled with different product boxes 26, 28 and 30, it being understood that each trough 16 will have boxes of a particular brand of product therein. Then, in each trough 16 is positioned a pusher assembly 32 which is best shown in FIG. 4.

Each pusher assembly 32 includes a rail 34 slidably mounting a pusher car 36 having a head plate 37. A spring band is mounted in the pusher car 36 in a coiled condition with an outer end 39 releasably attached to one end 40 or 42 of the rail 34. The spring band 38 is in a quiescent state when the band 38 is in a fully coiled state. This creates a pulling force toward the one end 40 or 42 of the rail 34 to which the outer end 39 of the spring band 38 is attached.

From the foregoing description, it will be understood that the drawer organizer 10 of the present invention has a number of advantages, some of which have been described above and others of which are inherent in the invention.

For example, the divider plates can be easily cut to different lengths to fit into different size drawers.

Also, the head plate 37 can be modified (made wider) to fit across a wider trough 16.

Further, a different type of biasing assembly can be utilized, although the pusher assembly 32 is preferred.

The drawer organizer is particularly useful in organizing boxes of cosmetics.

It will also be understood that modifications can be made to the drawer organizer 10 without departing from the teachings of the invention and the scope of the invention is only to be limited as necessitated by the accompanying claims.

I claim:

1. A drawer organizer assembly kit comprising:

two first rectangular divider plates each having two long edges and two short edges, a length longer than necessary to fit into a normally closed drawer in a cosmetic department of a store, and a plurality of spaced apart slots extending part way into said first divider plate from one long edge thereof whereby said first divider plates can be cut to a width to fit into a drawer;

at least three second rectangular divider plates each having two long edges and two short edges, a length longer than necessary to fit into a normally closed drawer in a cosmetic department of a store, and a plurality of spaced apart slots extending part way into each second divider plate from one long edge thereof whereby said second divider plates can be cut to a length to fit into a drawer;

said first and second divider plates being assembled with said first divider plates being-arranged, respectively, in a front area of a drawer and a rear area of a drawer, said second divider plates being received in one of said slots in said first divider plate to form at least one elongate product receiving trough when the divider plates are placed in a drawer;

and an elongate biasing assembly being received in each trough formed for urging boxes of a product in said trough toward the front area of the drawer, said biasing assembly comprising a rail, a pusher car slidably received on said rail and spring means for urging said pusher car against the boxes containing product therein received in said trough to maintain said boxes of product in a row in said trough.

2. The drawer organizer assembly kit of claim 1 combined with a drawer, in a cosmetic department of a store, that receives a plurality of small boxes containing cosmetic products and that is normally closed.

* * * * *